US008830081B2

(12) United States Patent
Aguirre et al.

(10) Patent No.: US 8,830,081 B2
(45) **Date of Patent: *Sep. 9, 2014**

(54) LINK QUALITY INDICATOR FOR A FIXED INSTALLATION RADIO FREQUENCY TERRESTRIAL NETWORK

(75) Inventors: Sergio Aguirre, Southlake, TX (US); Raafat E. Kamel, Little Falls, NJ (US); Kamlesh S. Kamdar, Dublin, CA (US); Lalit R. Kotecha, San Ramon, CA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 746 days.

This patent is subject to a terminal disclaimer.

(21) Appl. No.: 13/053,821

(22) Filed: Mar. 22, 2011

(65) Prior Publication Data

US 2012/0242495 A1 Sep. 27, 2012

(51) Int. Cl.
*G09F 9/33* (2006.01)

(52) U.S. Cl.
USPC ..... 340/815.45; 340/815.4; 340/815.56; 340/539.21; 370/315

(58) Field of Classification Search
USPC ..... 340/815.45, 815.4, 815.56, 539.21, 340/531, 539.1, 814.45; 370/241, 310, 315, 370/335; 455/11.1, 333, 422.1, 436
See application file for complete search history.

(56) References Cited

U.S. PATENT DOCUMENTS

| | | | | |
|---|---|---|---|---|
| 7,102,513 | B1 * | 9/2006 | Taskin et al. | 340/540 |
| 8,520,544 | B2 * | 8/2013 | Aguirre et al. | 370/252 |
| 8,521,151 | B2 * | 8/2013 | Cho et al. | 455/422.1 |
| 2005/0179607 | A1 | 8/2005 | Gorsuch et al. | |
| 2007/0173303 | A1 | 7/2007 | Viorel et al. | |
| 2010/0311321 | A1 | 12/2010 | Norin | |
| 2010/0313232 | A1 | 12/2010 | Norin | |
| 2011/0096680 | A1 * | 4/2011 | Lindoff et al. | 370/252 |
| 2012/0099428 | A1 * | 4/2012 | Kamdar et al. | 370/235 |

* cited by examiner

*Primary Examiner* — Hung T. Nguyen

(57) ABSTRACT

A visual indicator, such as a light emitting diode (LED), may display the quality of the radio frequency (RF) link. In one implementation, a device may include, a RF antenna; a control module to connect to a Long-Term Evolution (LTE) network through the RF antenna; and a LED, disposed on an outer surface of the device, to emit light of a number of different colors, where the color to emit is selected based on a quality of the connection to the LTE network. The device may include an outdoor broadband unit connected to an external portion of a customer premise.

31 Claims, 9 Drawing Sheets

115

LINK QUALITY INDICATOR FOR A FIXED INSTALLATION RADIO FREQUENCY TERRESTRIAL NETWORK

BACKGROUND

Bundled media services (e.g., combination packages of television, telephone, and broadband Internet services) have been successfully offered to households with wired connections to service provider networks. Households in areas without such wired connections (e.g., customers in regions that cannot be reached via conventional communication media, such as optical cables, copper cables, and/or other fixed wire-based technologies) may rely on fixed wireless services for some of these services (e.g., broadband access). However, previous generations of fixed wireless services have generally been unsuccessful. Expensive network equipment and customer premises equipment (CPE), high CPE installation costs, use of proprietary technology, and low data rates are among some of the reasons that these fixed wireless services remained unpopular.

As wireless network data rates improve using fourth generation (4G) technologies, such as Long-Term Evolution (LTE), such network data rates have become more attractive for fixed wireless networks. However, CPE and installation costs have remained a barrier to successfully promoting bundled services over fixed wireless networks.

DETAILED DESCRIPTION OF PREFERRED EMBODIMENTS

The following detailed description refers to the accompanying drawings. The same reference numbers in different drawings may identify the same or similar elements.

Systems and/or methods described herein may provide a customer premises equipment (CPE) wireless architecture with a simplified initial installation. Combined gateway equipment for the CPE architecture may include satellite and radio frequency (RF) antennas that are mounted (e.g., on a roof), by an installer, at the customer premise. The combined gateway equipment may be adjustable so that the installer can, for example, rotate an extension arm onto which the RF antenna is attached. A visual indicator, such as a light emitting diode (LED), may display the quality of the RF link. In one implementation, the LED may display a different color depending on a quality of the RF link (e.g., green for a "good" quality link, amber or yellow for a "marginal" quality link, and red for a "poor" quality link). The installer may thus adjust the position/orientation of the combined gateway equipment to maximize the quality of the RF link without having to use additional equipment or to manually take additional link measurements.

Figure 1:
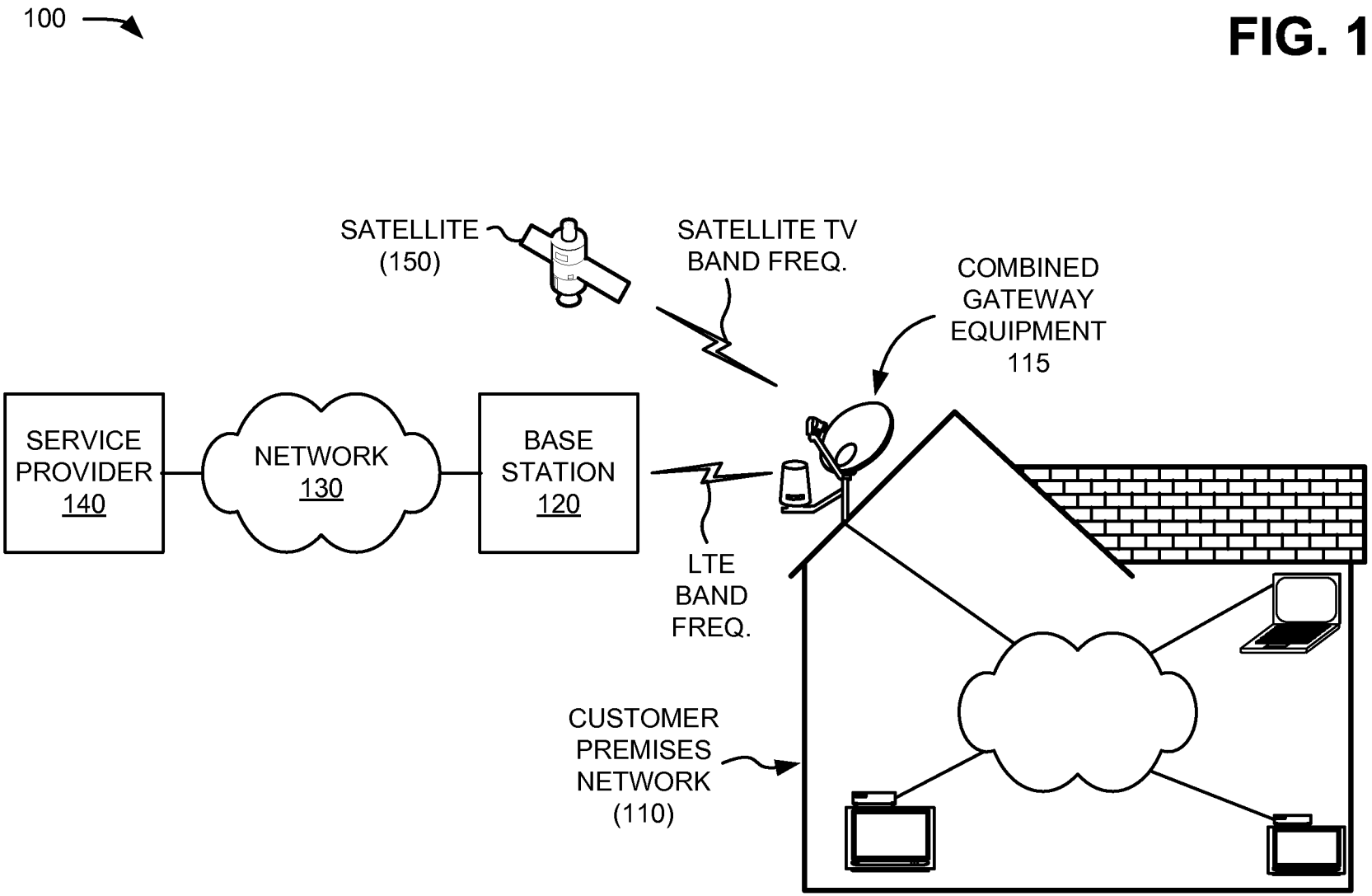
FIG. 1 is a diagram of an example environment in which systems and/or methods described herein may be implemented.

FIG. 1 is a diagram of an example environment 100 in which systems and/or methods described herein may be implemented. As illustrated, environment 100 may include a customer premises network 110, combined gateway equipment 115, a base station 120, a network 130, a service provider 140, and a satellite network 150. A single customer premises network 110, base station 120, network 130, service provider 140, and satellite network 150 have been illustrated in FIG. 1 for simplicity. In practice, there may be more customer premises networks 110, combined gateways 115, base stations 120, networks 130, service providers 140, and/or satellite networks 150.

Customer premises network 110 may include one or more devices connected to each other, base station 120, and/or satellite network 150. Devices in customer premises network 110 may include, for example, set-top boxes (STBs), televisions, computers, and home networking equipment (e.g., routers, cables, splitters, local gateways, etc.). Devices within customer premises network 110 may be connected via wired (e.g., coaxial cable, Telecommunications Industry Association category 5 ("cat 5") cable, etc.) or wireless connections (e.g., using network devices such as those available under the IEEE 802.11 wireless LAN standards). In the example shown in FIG. 1, customer premises network 110 may connect to base station 120 through a two-way wireless connection (e.g., using an LTE band frequency) and may connect to satellite network 150 through a one-way (e.g., downlink) wireless connection (e.g., using a satellite TV band frequency). The two-way wireless connection and the one-way wireless connection may be implemented using combined gateway equipment 115.

Combined gateway equipment 115, which is described in more detail below, may generally include mechanisms for communicating with satellite network 150 (to provide satellite-based communications) and for communicating with base station 120 (to provide RF-based communications). Combined gateway equipment 115 may connect, such as via a coaxial connection, to devices inside of the customer premise, such as the devices connected to customer premises network 110.

Base station 120 may include one or more computation and/or communication devices that receive voice and/or data (e.g., video content) from service provider 140 (e.g., via network 130) and transmit that voice and/or data to customer premises network 110. Base station 120 may also include one or more devices that receive voice and/or data from customer premises network 110 and transmit that voice and/or data to service provider 140 (e.g., via network 130). In one example implementation, base station 120 may utilize LTE standards operating in a 700 megahertz (MHz) frequency band.

Network 130 may include a local area network (LAN), a wide area network (WAN), a metropolitan area network (MAN), a telephone network, such as the Public Switched Telephone Network (PSTN), an intranet, the Internet, an optical fiber (or fiber optic)-based network, a cable television network, a satellite television network, or a combination of networks.

Service provider 140 may include one or more server devices, or other types of computation or communication devices, that gather, process, search, and/or provide information in a manner described herein. In one implementation, service provider 140 may include a web server, computer system, an application, a cable head-end, and/or a broadcasting device capable of providing Internet Protocol (IP)-based content and/or services to devices in customer premises network 110.

Satellite network 150 may provide multimedia content from, for example, a direct broadcast satellite (DBS) service provider (not shown). Satellite network 150 may provide a downlink signal over a designated satellite TV band frequency, typically in the range of 950 MHz to 2150 MHz. The downlink signal may be received using a satellite antenna/receiver system at the customer premise to present satellite TV content to a user.

In implementations described herein, customer premises network 110 may combine LTE functionality with satellite TV service. Using combined gateway equipment 115, which includes an outdoor LTE modem, both broadband (over LTE) service (e.g., via base station 120) and satellite TV service (e.g., via satellite network 150) may be brought into customer premises network 110 over a single coaxial line. This architecture may reduce equipment installation time due to the use of a single coaxial line for all the services. Both installation costs and recurrent operational costs can be reduced.

While implementations herein are described primarily in the context of broadband services via LTE, other wireless protocols may be used. For example, components conforming to LTE standards described herein may be replaced by components conforming to other network protocols, such as, for example, Global System for Mobile Communications (GSM), wideband code division multiple access (WCDMA), Ultra Mobile Broadband (UMB), Universal Mobile Telecommunications System (UMTS), Code Division Multiple Access 2000 (CDMA2000), High-Speed Packet Access (HSPA), Worldwide Interoperability for Microwave Access (WiMax), etc.

Although FIG. 1 shows example components of environment 100, in other implementations, environment 100 may contain fewer components, different components, differently arranged components, and/or additional components than those depicted in FIG. 1. Alternatively, or additionally, one or more components of environment 100 may perform one or more other tasks described as being performed by one or more other components of environment 100.

Figure 2:
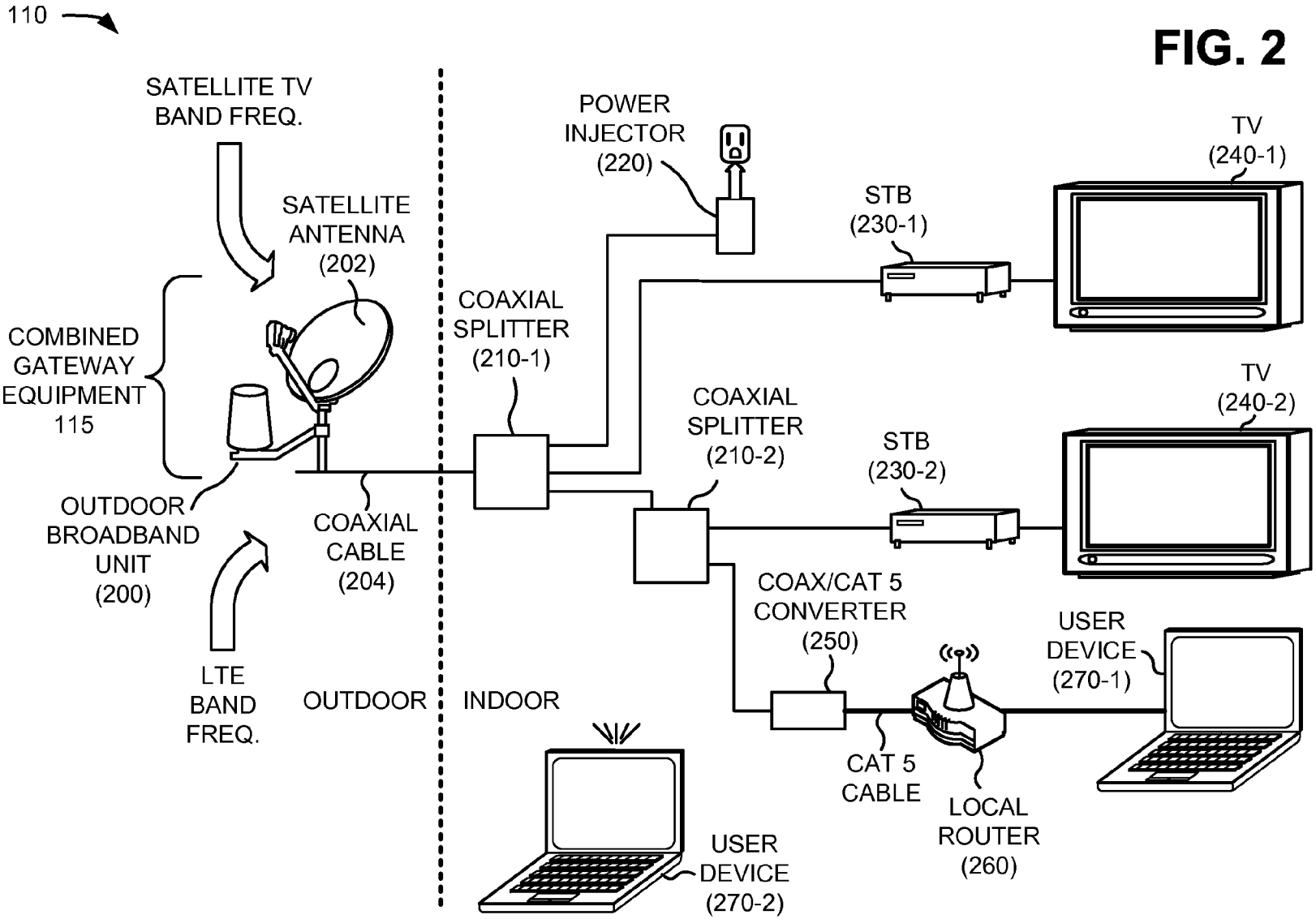
FIG. 2 is a diagram of an example customer premises network illustrated in FIG. 1 according to an implementation described herein.

FIG. 2 is a diagram of an example customer premises network 110 according to an implementation described herein. As illustrated, combined gateway equipment 115 of customer premises network 110 may include an outdoor broadband unit 200 and a satellite antenna 202. A coaxial cable 204 may connect combined gateway equipment 115 to the indoor portion of customer premises network 110. Customer premises network 110 may further include coaxial splitters 210-1 and 210-2 (referred to herein collectively as "coaxial splitters 210" or generically as "coaxial splitter 210"), a power injector 220, set-top boxes (STBs) 230-1 and 230-2 (referred to herein collectively as "STBs 230" or generically as "STB 230"), televisions 240-1 and 240-2 (referred to herein collectively as "televisions 240"), a coax/Cat 5 converter 250, a local router 260, and user devices 270-1 and 270-2 (referred to herein collectively as "user devices 270" or generically as "user device 270"). One outdoor broadband unit 200, two coaxial splitters 210, one power injector 220, two STBs 230, two televisions 240, one coax/Cat 5 converter 250, one local router 260, and two user devices 270 have been illustrated in FIG. 2 for simplicity. In practice, there may be more (or fewer) outdoor broadband units 200, satellite antennas 202, coaxial splitters 210, power injectors 220, STBs 230, televisions 240, coax/Cat 5 converters 250, local routers 260, and/or user devices 270.

Outdoor broadband unit 200 may include one or more data processing and/or data transfer devices, such as a gateway, a router, a modem, a switch, a firewall, a network interface card (NIC), a hub, a bridge, a proxy server, an optical add-drop multiplexer (OADM), or some other type of device that processes and/or transfers data. In one example, outdoor broadband unit 200 may include a wireless gateway that provides a convergence point between wireless protocols (e.g., associated with base station 120) and IP protocols (e.g., associated with user devices 270). Outdoor broadband unit 200 may be physically deployed with satellite antenna 202 (e.g., on a roof or a side wall of a house associated with customer premises network 110) as part of combined gateway 115. For example, outdoor broadband unit 200 may utilize a pre-existing or a new satellite TV installation in a way that both broadband (over LTE) service and satellite TV are brought indoors (e.g., inside the customer premises) over a coaxial cable 204. Outdoor broadband unit 200 is discussed further in connection with, for example, FIGS. 3-5.

Satellite antenna 202 may provide an interface for television service broadcast from satellites. In one implementation, satellite antenna 202 may provide an entry point for a network (e.g., customer premises network 110) that conforms to standards of the Multimedia over Coax Alliance (MoCA). Generally, MoCA-compliant devices may be used to implement a home network on existing coaxial cable, using, for example, orthogonal frequency-division multiplexing (OFDM) modulation that divides data into several parallel data streams or logical channels. Channel stacking technology, such as Single Wire Multiswitch (SWiM) technology, may be used to allocate logical channels using frequency blocks for user-selected programming to the SWiM compatible devices (e.g., STBs 230). Satellite antenna 202 may communicate with STB 230 to identify which blocks of channels can be used to send television signals to that particular STB 230.

Coaxial splitters 210 may include conventional splitting technologies to filter LTE and satellite TV signals. In one implementation, each coaxial splitter 210 may include a SWiM splitter. For example, coaxial splitters 210 may facilitate allocating logical channels using different frequency blocks for viewer-selected television programming and broadband signals to the SWiM-compatible STBs 230 and/or local router 260.

Power injector 220 may include a conventional mechanism for injecting DC power in a coaxial cable to power remotely-located devices, such as outdoor broadband unit 200. Use of power injector 220 may allow components of outdoor broadband unit 200 to be powered via a coaxial cable (e.g., coaxial cable 204) and eliminate the need for additional wiring.

STB 230 may include a device that receives and/or processes video content (e.g., from a satellite TV provider via satellite antenna 202), and provides the video content to television 240 or another device. STB 230 may also include decoding and/or decryption capabilities and may further include a digital video recorder (DVR) (e.g., a hard drive). In one example implementation, STB 230 may be incorporated directly within television 240. In another implementation, STB 230 and/or television 240 may be replaced with a computing device (e.g., a personal computer, a laptop computer, a tablet computer, etc.), a cable card, a TV tuner card, or a portable communication device (e.g., a mobile telephone or a personal digital assistant (PDA)). In one implementation, STB 230 may conform to MoCA and SWiM standards.

Television 240 may include a television monitor that is capable of displaying video content, television programming, content provided by STB 230, and/or content provided by other devices (e.g., a digital video disk (DVD) player, a video camera, etc., not shown) connected to television 240. Coax-to-Cat 5 converter 250 may include a conventional device to convert incoming signals from coaxial cables to outgoing signals on Cat 5 cables.

Local router 260 may include a device that may provide connectivity between equipment within customer premises (e.g., user devices 270) and between the customer premises equipment and an external network (e.g., network 130). In one implementation, local router 260 may include a wireless access point that employs one or more short-range wireless communication protocols for a wireless personal area network (WPAN) and/or a wireless local area network (WLAN), such as, for example, IEEE 802.15 (e.g., Bluetooth) and IEEE 802.11 (e.g., Wi-Fi). In other implementations, different short-range wireless protocols and/or frequencies may be used. Local router 260 may also include one or more wired (e.g., Ethernet) connections. In one implementation, local router 260 may include a USB Ethernet Router that is capable of meeting LTE quality of service (QoS) standards.

User device 270 may include any device that is capable of communicating with customer premises network 110 via local router 260. For example, user device 270 may include a mobile computation and/or communication device, such as a laptop computer, a radiotelephone, a personal communications system (PCS) terminal (e.g., that may combine a cellular radiotelephone with data processing and data communications capabilities), a PDA (e.g., that can include a radiotelephone, a pager, Internet/intranet access, etc.), a wireless device, a smart phone, a global positioning system (GPS) device, a content recording device (e.g., a camera, a video camera, etc.), etc. In another example, user device 270 may include a fixed (e.g., provided in a particular location, such as within a customer's home) computation and/or communication device, such as a laptop computer, a personal computer, a tablet computer, a gaming system, etc.

Although FIG. 2 shows example components of customer premises network 110, in other implementations, customer premises network 110 may contain fewer components, different components, differently arranged components, and/or additional components than those depicted in FIG. 2. Alternatively, or additionally, one or more components of customer premises network 110 may perform one or more other tasks described as being performed by one or more other components of customer premises network 110.

Figure 3:
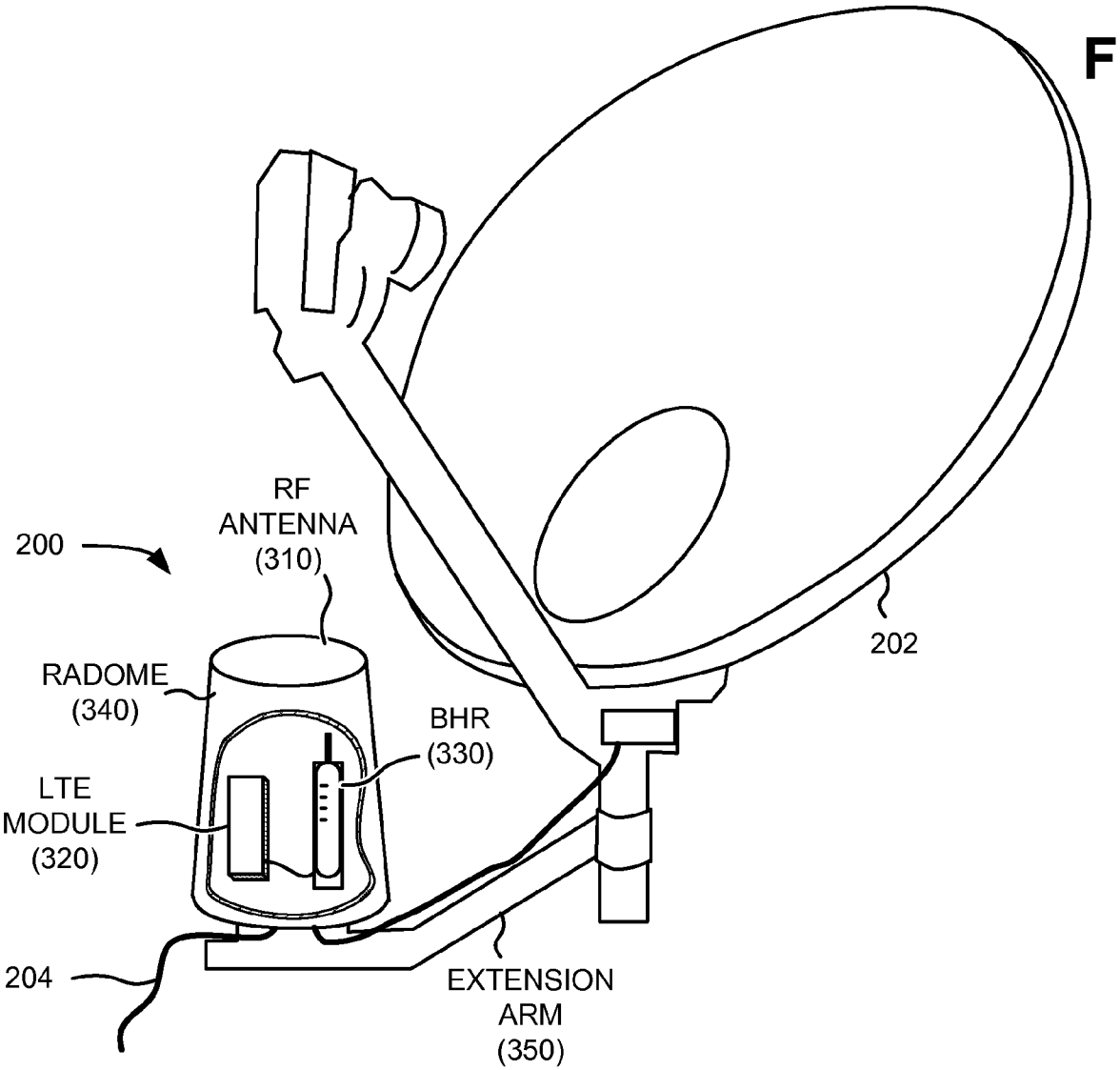
FIGS. 3 and 4 are diagrams of example components of an outdoor portion of the customer premises network depicted in FIG. 2.

FIG. 3 is a diagram of example components of combined gateway equipment 115 of customer premises network 110. As illustrated, combined gateway equipment 115 may include outdoor broadband unit 200 and satellite antenna 202. Outdoor broadband unit 200 may include a radio frequency (RF) antenna 310, an LTE module 320, and a broadband home router (BHR) 330, all housed in a radome 340. Satellite antenna 202 my include features described above in connection with, for example, FIGS. 1 and 2. In one implementation, as shown in FIG. 3, outdoor broadband unit 200 may be mounted on an extension arm 350 connected to a pole supporting satellite antenna 202.

RF antenna 310 may include an antenna to transmit and/or receive RF signals over the air. RF antenna 310 may, for example, receive RF signals from LTE module 320/BHR 330 and transmit the RF signals over the air. Also, RF antenna 310 may, for example, receive RF signals over the air and provide them to LTE module 320/BHR 330. In one implementation, for example, LTE module 320/BHR 330 may communicate with a base station (e.g., base station 120) connected to a network (e.g., network 130) to send and/or receive signals from user devices 270. In implementations herein, RF antenna 310 may be enclosed by radome 340, integrated with radome 340, or external to radome 340. While one RF antenna 310 is shown in FIG. 3, outdoor broadband unit 200 may include more than one antenna in other implementations.

In one implementation, RF antenna 310 may include a wideband multiple beam antenna, with partially overlapping antenna beams, spanning 360 degrees in azimuth (x-y plane). For example, antenna 310 may include between four and eight beams (e.g., to achieve desirable antenna gains and reduction of interference). Additionally, or alternatively, RF antenna 310 may employ two polarizations per beam for 2×2 downlink multiple-input and multiple-output (MIMO) operation.

In another implementation, RF antenna 310 may include a fixed dually-polarized directional antenna. As a directional antenna, RF antenna 310 may use polarizations matched to the polarizations of a particular base station (e.g., base station 120). For example, polarization of RF antenna 310 may be matched in polarization with a serving enhanced Node B (eNB) or base station (e.g., base station 120). Antenna pointing for the directional antenna may be conducted, for example, during installation of outdoor broadband unit 200.

LTE module 320 may include hardware or a combination of hardware and software having communication capability via an air interface. For example, LTE module 320 may receive broadband signals and/or voice over Internet protocol (VoIP) signals from base station 120 (e.g., via RF antenna 310) and transmit broadband signals and/or VoIP signals to base station 120 (e.g., via RF antenna 310). LTE module 320 may employ frequency division duplex (FDD) and/or time division duplex (TDD) techniques to facilitate downlink and uplink transmissions. In one implementation, LTE module 320 may include a beam selection mechanism that selects the best antenna beam, from RF antenna 310, according to a certain optimization criteria. Beam selection may be performed, for example, during initial installation and/or regular maintenance of outdoor broadband unit 200. Additionally, or alternatively, LTE module 320 may select any of the RF antenna 310 beams, based on real-time measurements, during normal operation.

BHR 330 may include a device for buffering and forwarding data packets toward destinations. For example, BHR 330 may receive data packets from base station 120 (e.g., via LTE module 320) and forward the data packets toward user devices 270. In addition, BHR 330 may receive data packets from user devices 270 (e.g., via local router 260) and forward the data packets toward recipient devices (e.g., service provider 140) via network 130. BHR 330 may include a bridge device to receive signals from LTE module 320 via a wired universal serial bus (USB) connection and convert the signals to an Ethernet over coax signal. The Ethernet over coax signal may be assigned a logical channel (e.g., according to SWiM guidelines) and may be combined with coaxial input from satellite antenna 202. In one implementation, the output from BHR 330 may be inserted in a Mid-RF MoCA channel that is separate from the 950 MHz to 2150 MHz range of a typical satellite TV system.

Radome 340 (shown with cut-away view to reveal LTE module 320 and BHR 330) may provide a weatherproof enclosure to protect RF antenna 310, LTE module 320, BHR 330 and/or other components of outdoor broadband unit 200.

Generally, radome 340 may include any RF transparent structure that protects components in an outdoor environment.

Combined gateway equipment 115 may be integrated with the SWiM environment associated with satellite antenna 202 to provide both TV service and broadband wireless service. With this architecture, combined gateway equipment 115 may require only one coax line leading from outdoor broadband unit 200/satellite antenna 202. This single coaxial line may feed the in-home coaxial installation to deliver satellite TV service and LTE service to corresponding STBs 230 and user devices 270 (e.g., as shown in FIG. 2). Components of outdoor broadband unit 200, such as RF antenna 310, LTE module 320, and BHR 330, may be powered using coax cable 204.

Although FIG. 3 shows example components of network portion 300, in other implementations, network portion 300 may contain fewer components, different components, differently arranged components, and/or additional components than depicted in FIG. 3. Alternatively, or additionally, one or more components of network portion 300 may perform one or more other tasks described as being performed by one or more other components of network portion 300. In one alternative implementation, one or more functions of combined gateway equipment 115 may moved to another location, such as internal to the customer premise. For example, a bridge may be installed in combined gateway equipment 115 instead of BHR 330. The bridge may function to combine coaxial input from satellite antenna 202 with the output from LTE module 320 into a single coax line, which may be forwarded to a broadband router that is installed inside the customer premise.

Figure 4:
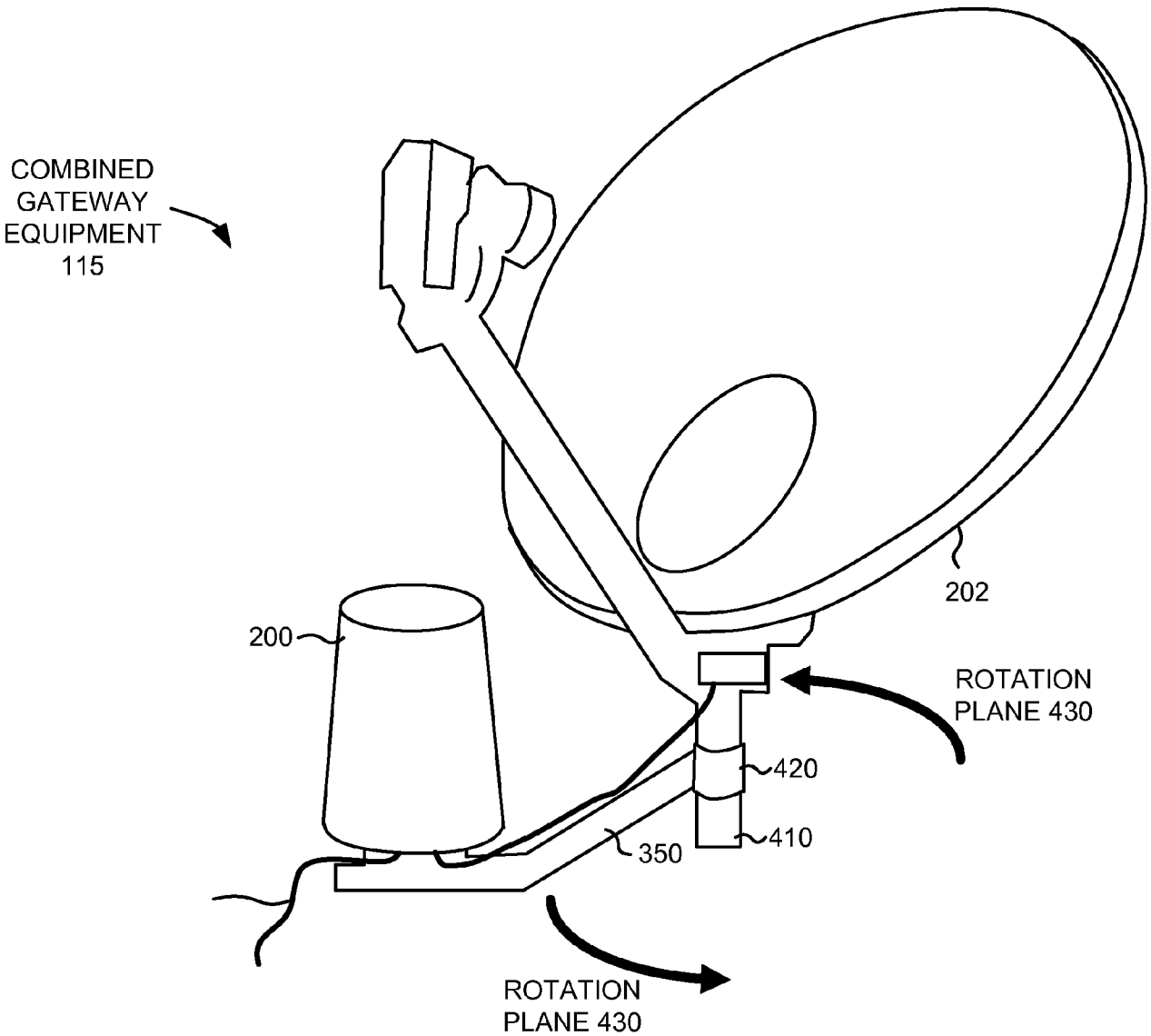

FIG. 4 is a diagram illustrating another example of combined gateway equipment 115. As shown in FIG. 4, extension arm 350 and outdoor broadband unit 200 (including RF antenna 310, LTE module 320, BHR 330, and radome 340) may be rotatably adjustable around a support arm 410 of combined gateway equipment 115. A collar 420 may be used to tighten and release extension arm 350 so that extension arm 350 can be rotated around support arm 410. Support arm 410 may provide the support for satellite antenna 202 and outdoor broadband unit 200.

An installer that is installing combined gateway equipment 115 may loosen collar 420 to adjust the rotation of extension arm 350 (and outdoor broadband unit 200). Rotating extension arm 350 around support art 410 may rotate outdoor broadband unit 200 through a rotation plane 430. The installer may adjust the rotation of extension arm 350 in order to find an "optimal" physical position for the reception of RF signals from base station 120 (e.g., over the LTE frequency band).

Although collar 420 is illustrated in FIG. 4 as connecting support arm 410 to extension arm 350, in alternative implementations, other physical connection mechanisms may be used.

Figure 5:
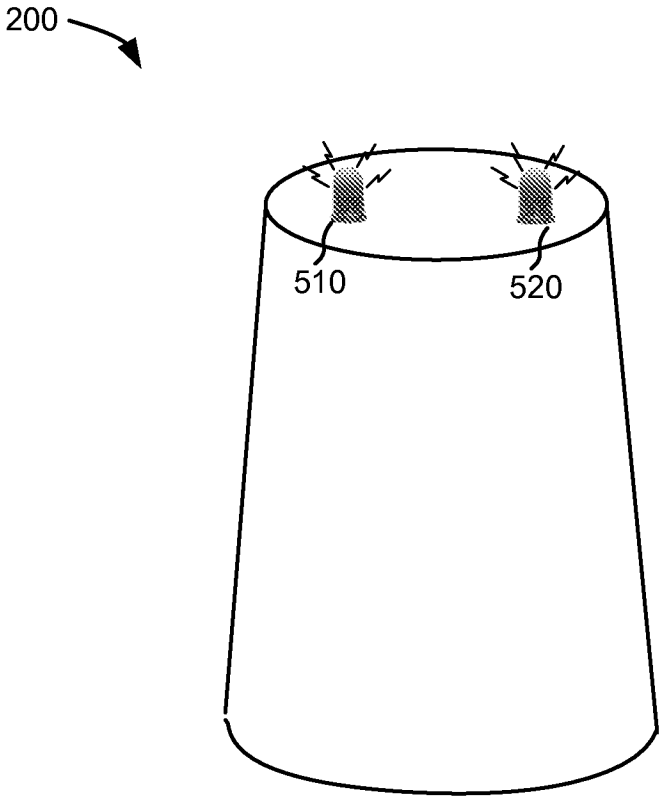
FIG. 5 is a diagram illustrating additional aspects of the outdoor broadband unit of FIG. 2.

FIG. 5 is a diagram illustrating additional aspects of outdoor broadband unit 200. Visual indicators 510 and 520 are illustrated as being disposed on outdoor broadband unit 200. Visual indicators 510 and 520 may include, for example, light emitting diodes (LEDs) or other types of indicators. In one implementation, one or more of visual indicators 510/520 may be multi-color devices that are capable of emitting light in one of a number of colors. For example, visual indicator 510 may be a red LED and visual indicator 520 may be an LED that can be controlled to appear red, green, or yellow. The state of visual indicators 510/520 may be controlled, for example, by LTE module 320. In one implementation, and as described in more detail below, visual indicator 510 may be a red LED that is on when outdoor broadband unit 200 is connected to a power supply, such as power received over coax cable 204 and injected by power injector 220. Visual indicator 520 may provide an indication of the signal strength and/or quality being received from base station 120 by outdoor broadband unit 200.

Although visual indicators 510/520 are illustrated in FIG. 5 as being disposed on the top of outdoor broadband unit 200, in other implementations, visual indicators 510/520 may be located at other locations on outdoor broadband unit 200 or combined gateway equipment 115. For example, visual indicators 510/520 may be located on the bottom of outdoor broadband unit 200. This may be beneficial as, for instance, an installer installing combined gateway equipment 115 on a rooftop of a customer premise may generally be "looking up" at combined gateway equipment 115 during the installation. In yet another possible implementation, visual indicators 510/520 may be located on the sides of outdoor broadband unit 200.

Figure 6:
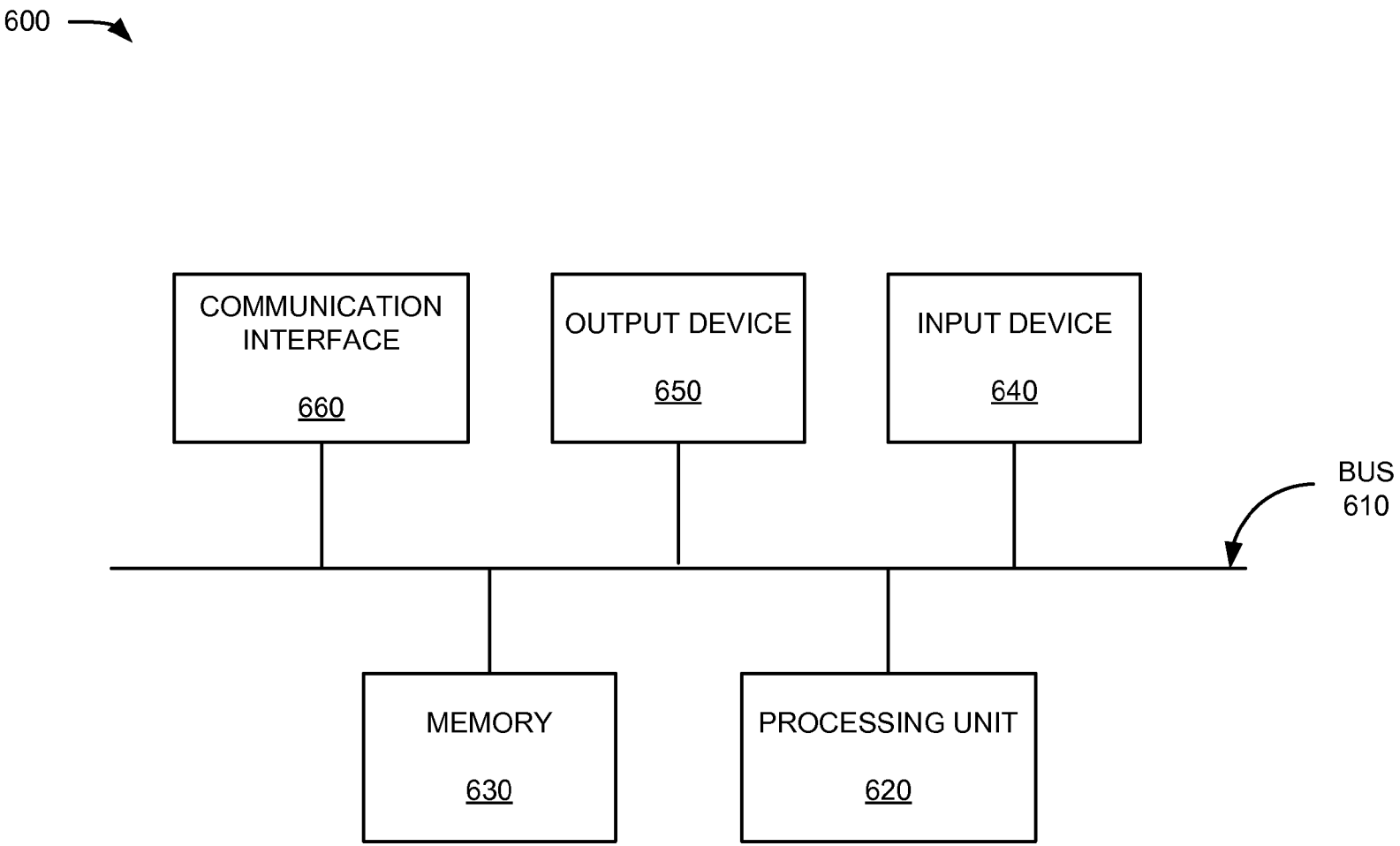
FIG. 6 is a diagram of example components of a device that may correspond to one of the devices of in FIG. 1 or 2.

FIG. 6 is a diagram of example components of a device 600 that may correspond to one of the devices of environment 100 and/or customer premises network 110 (e.g., LTE module 320 and/or BHR 330). As illustrated, device 600 may include a bus 610, a processing unit 620, a memory 630, an input device 640, an output device 650, and a communication interface 660.

Bus 610 may permit communication among the components of device 600. Processing unit 620 may include one or more processors or microprocessors that interpret and execute instructions. In other implementations, processing unit 620 may be implemented as or include one or more application specific integrated circuits (ASICs), field programmable gate arrays (FPGAs), or the like.

Memory 630 may include a random access memory (RAM) or another type of dynamic storage device that stores information and instructions for execution by processing unit 620, a read only memory (ROM) or another type of static storage device that stores static information and instructions for the processing unit 620, and/or some other type of magnetic or optical recording medium and its corresponding drive for storing information and/or instructions.

Input device 640 may include a device that permits an operator to input information to device 600, such as a keyboard, a keypad, a mouse, a pen, a microphone, one or more biometric mechanisms, and the like. Output device 650 may include a device that outputs information to the operator, such as a display, a speaker, etc.

Communication interface 660 may include any transceiver-like mechanism that enables device 600 to communicate with other devices and/or systems. For example, communication interface 660 may include mechanisms for communicating with other devices, such as other devices of environment 100 and/or customer premises network 110.

As described herein, device 600 may perform certain operations in response to processing unit 620 executing software instructions contained in a computer-readable medium, such as memory 630. A computer-readable medium may be defined as a non-transitory memory device. A memory device may include space within a single physical memory device or spread across multiple physical memory devices. The software instructions may be read into memory 630 from another computer-readable medium or from another device via communication interface 660. The software instructions contained in memory 630 may cause processing unit 620 to perform processes described herein. Alternatively, hardwired circuitry may be used in place of or in combination with software instructions to implement processes described herein. Thus, implementations described herein are not limited to any specific combination of hardware circuitry and software.

Although FIG. 6 shows example components of device 600, in other implementations, device 600 may contain fewer components, different components, differently arranged components, or additional components than depicted in FIG. 6. Alternatively, or additionally, one or more components of device 600 may perform one or more other tasks described as being performed by one or more other components of device 600.

Figure 7:
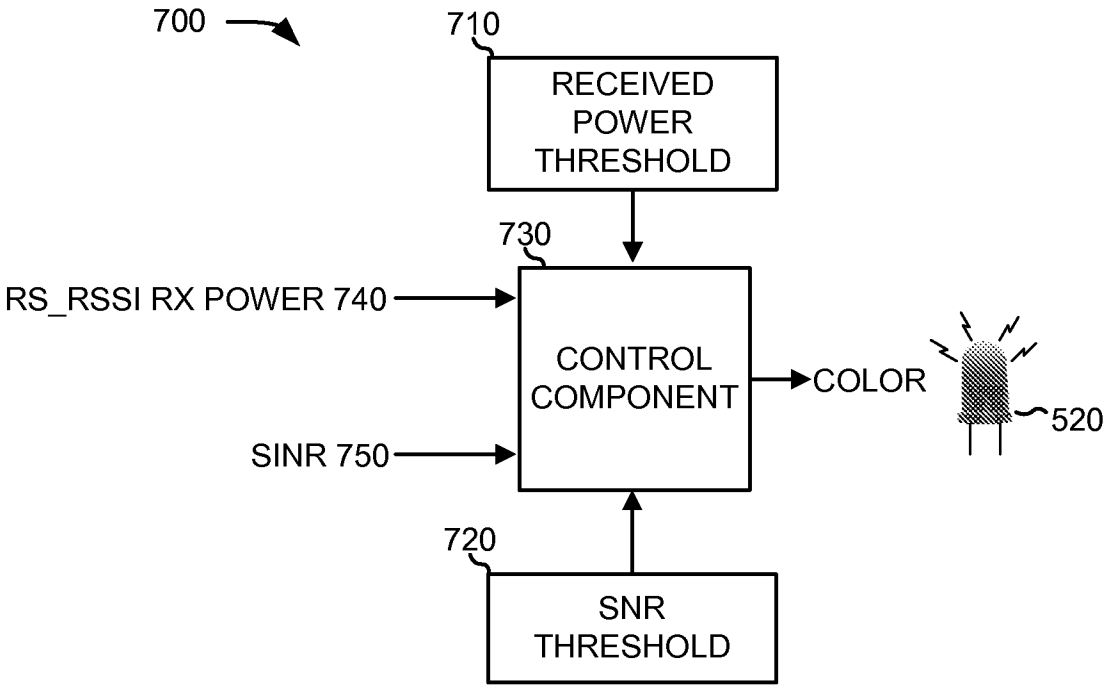
FIG. 7 is a conceptual diagram illustrating example functional components for controlling visual indicators on an outdoor broadband unit.

FIG. 7 is a conceptual diagram illustrating example functional components 700 for controlling visual indicators. In one implementation, functional components 700 may be implemented by LTE module 320 in hardware, software, or a combination of hardware and software. Functional components 700 may include a received power threshold register 710, a signal-to-noise (SNR) threshold register 720, and a control component 730.

Received power threshold register 710 may store one or more value(s) relating to acceptable levels of LTE downlink signal power. Default values for received power threshold register 710 may be set during manufacture of LTE module 320 or set during installation by the installer. In some implementations, the values stored in received power threshold register 710 may be dynamically updated, during operation of outdoor broadband unit 200, such as by the reception of updated values from service provider 140. The value(s) stored in received power threshold register 710 may be provided to or read by control component 730.

SNR threshold register 720 may store one or more value(s) relating to acceptable levels of signal to interference and noise ratios (SINRs). Default values for SNR threshold register 720 may be set during manufacture of LTE module 320. In some implementations, the values stored in SNR threshold register 720 may be dynamically updated, during operation of outdoor broadband unit 200, such as by the reception of updated values from service provider 140. The value(s) stored in SNR threshold register 720 may be provided to or read by control component 730.

Control component 730 may control the color and/or the on/off state of an LED, such as visual indicator 520. Control component 730 may control visual indicator 520 based on input signals relating to quality and/or throughput of the wireless LTE link. Two example signals are particularly illustrated: RS_RSSI RX power 740 and SINR 750. RS_RSSI RX power 740 may represent the average received power, per receiving antenna port, based on the transmitted power per single transmit antenna. SINR 750 may represent a signal to interference and noise ratio as measured for LTE downlink signals. RS_RSSI RX power 740 and SINR 750 may be measured and/or calculated by LTE module 320.

Control component 730 may control visual indicator 520 based on RS_RSSI RX power 740, SINR 750, the threshold value(s) stored in received power threshold register 710, and the threshold value(s) stored in SNR threshold register 720. In one implementation, in which visual indicator 520 is a three color LED, control component 730 may control visual indicator 520 to emit a "good" signal strength color (e.g., green) when both minimum threshold values for RS_RSSI RX power 740 and SINR 750 are met; and emit a "marginal" signal strength color (e.g., yellow or amber) or a "poor" signal strength color (e.g., red) when one of the minimum threshold values for RS_RSSI RX power 740 and SINR 750 are not met.

Table I, below, lists example threshold values that may be used by control component 730 and stored by received power threshold register 710 and SNR threshold register 720. Other threshold values could alternatively be used, and as discussed in more detail below, may be updated, such as from service provider 140, through a protocol such as the TR-069 device management interface. As shown, for RS_RSSI RX power 740, a signal strength greater than or equal to −88 dBm (power ratio in decibels of the measured power referenced to one milliwatt) may correspond to good signal strength (green LED), a signal strength between −88 and −94 dBm may correspond to marginal signal strength (yellow LED), and a signal strength less than −94 dBM may correspond to poor service or no service (red LED). For SINR 750, a signal strength greater than or equal to 7 dB (decibels) may correspond to good signal strength (green LED), a signal strength between 2 and 7 dB may correspond to marginal signal strength (yellow LED), and a signal strength less than 2 dB may correspond to poor service or no service (red LED). With these example thresholds, control component 730 may control visual indicator 520 to be green when both RS_RSSI RX power 740 and SINR 750 are "good", and when both are not good, control component 730 may control visual indicator 520 to be the lesser color of the states of RS_RSSI RX power 740 and SINR 750 (e.g., visual indicator 520 may be red when RS_RSSI RX power 740 or SINR 750 indicates poor service or no service and visual indicator 520 may be yellow when one of RS_RSSI RX power 740 or SINR 750 is marginal and the other is marginal or good).

TABLE I

| LTE Downlink RS__RSSI (dBm) | LED Color |
|---|---|
| −88 <= RS-RSSI | Green (good) |
| −94 <= RS-RSSI < −88 | Yellow (marginal) |
| −94 > RS-RSSI | Red (poor) |
| No Service | Red (no service) |
| **LTE Downlink SINR (dB)** | **LED Color** |
| 7 <= SINR | Green (good) |
| 2 <= SINR < 7 | Yellow (marginal) |
| 2 > SINR | Red (poor) |
| No Service | Red (no service) |

In one implementation, control component 730, in addition to controlling visual indicator 520 to be a particular color that is indicative of signal strength, may also control the appearance of visual indicator 520 in other ways. For example, visual indicator 520 may be controlled to blink on and off when the link to the LTE network is active. Alternatively, visual indicator 520, instead of using color to indicate signal strength, may, for example, blink in a pre-determined pattern to indicate signal strength. Alternatively, instead of being an LED, visual indicator 520 may be another type of visual display, such as a liquid crystal display (LCD), that may directly display an indication of signal strength (such as by displaying one to four "bars" that indicate signal strength). Further, in yet another possible alternative, visual indicator 520 may, instead of being a visual indicator, may include an audio indicator, such as a speaker, that emits one or more tones that indicate signal strength.

Although FIG. 7 shows example functional components 700 for controlling visual indicators 510/520, in other implementations, functional components 700 may contain fewer components, different components, differently arranged components, and/or additional components than those depicted in FIG. 7. Alternatively, or additionally, one or more of functional components 700 may perform one or more other tasks described as being performed by one or more other components of functional components 700.

Figure 8:
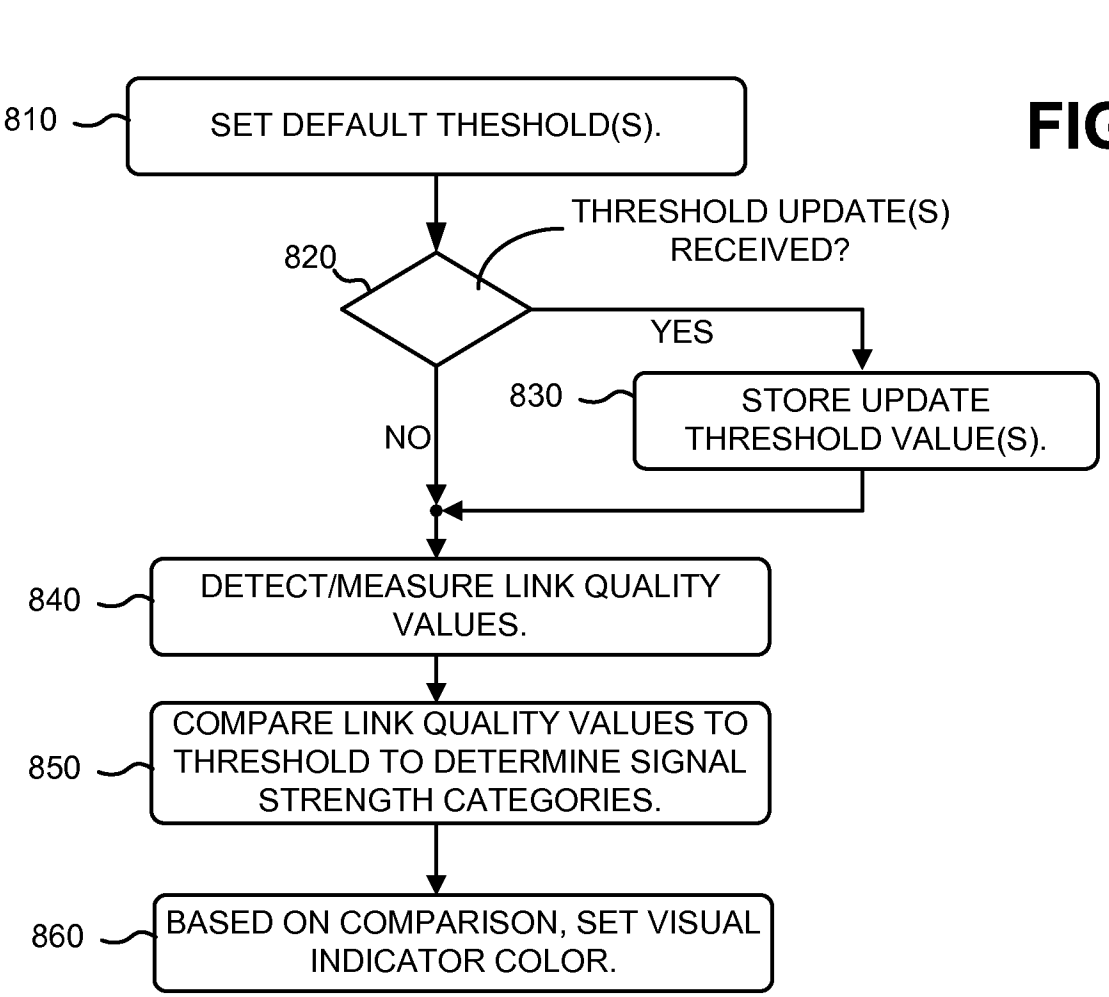
FIG. 8 is a flow chart of an example process for controlling a visual indicator for an outdoor broadband unit.

FIG. 8 is a flow chart of an example process 800 for controlling visual indicator 520 for outdoor broadband unit 200. In one implementation, process 800 may be performed by LTE module 320 and visual indicator 520. In another implementation, some or all of process 800 may be performed by another device or group of devices, including or excluding LTE module 320.

Process 800 may include setting default thresholds (block 810). The default thresholds may be set for received power threshold register 710 and SNR threshold register 720. In one implementation, default threshold values, such as those shown in Table I, may be set during manufacture of outdoor broadband unit 200. In other implementations, the default threshold values may be set in other ways, such as by a technician before installing outdoor broadband unit 200 or by service provider 140.

Process 800 may include receiving updates to the default threshold values (block 820). The updates may be received from service provider 140. For example, when combined gateway 115 is connected to and communicates with service provider 140, service provider 140 may transmit threshold value updates. The threshold values may be transmitted from service provider 140 to combined gateway equipment 115 using a standard such as the TR-069 specification, which defines an application layer protocol for remote management of end-user devices. In one implementation, the threshold value updates may be values that are customized for the user based on the particular location of the customer premise in the LTE network (e.g., based on the distance from the customer premise to the nearest base station 120). Alternatively, the threshold value updates may be based on other factors, such as the particular model of equipment being used by combined gateway equipment 115 or typical load values of the cell corresponding to base station 120. For example, if the customer premise is near base station 120, the threshold values may be updated to higher than normal values based on the assumption that a high quality wireless link should be obtainable.

When update threshold values are received, the update threshold values may be stored by outdoor broadband unit 200 (block 820—YES, and block 830). For example, the updates values may be stored in received power threshold register 710 and SNR threshold register 720.

During operation of outdoor broadband unit 200, values relating to the link quality with base station 120, such as RS_RSSI RX power 740 and SINR 750, may be continuously or occasionally detected or measured (block 840). LTE module 320 may, for example, periodically (e.g., every one second) measure RS_RSSI RX power 740 and SINR 750. The measured values may be compared to the threshold values to determine a category for each signal (block 850). In one implementation, and as discussed above with reference to Table I, two threshold values may be defined for each measured signal and used to classify the measured signals into one of three categories (e.g., a good signal, a marginal signal, or a poor signal), where each category relates to the received quality of the signal.

Process 800 may further include setting, based on the result of the comparison, the color of a visual indicator (block 860). As mentioned previously, visual indicator 520 may include a three-color LED, in which the colors correspond to each of the three categories of the measured signal strength. In one implementation, when multiple signals are measured by LTE module 320, such as RS_RSSI RX power 740 and SINR 750, the color of visual indicator 520 may be set as the color corresponding to the lowest category from the multiple signals. For instance, in the example using the signals RS_RSSI RX power 740 and SINR 750, the color of visual indicator 520 may be set to green (good signal) when both signals are categorized as good, yellow (moderate signal) when at least one of the signals is categorized as moderate but neither is poor, and red when at least one of the signals is categorized as poor.

Although, in the above description, three LED colors, three signal categories (good, marginal, and poor), two quality signals (RS_RSSI and SINR), and two threshold values were described, in alternative implementations, more or fewer LED colors, signal categories, quality signals, and threshold values may be used.

Figure 9:
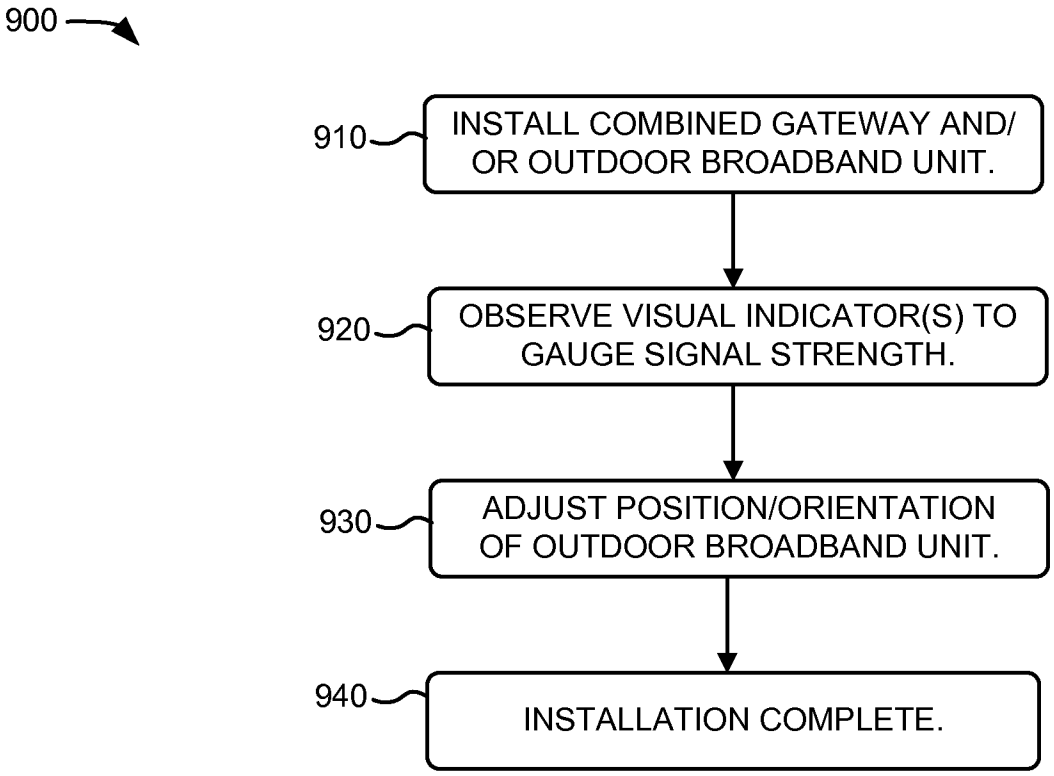
FIG. 9 is a flow chart of an example process through which a technician may install combined gateway equipment and/or an outdoor broadband unit.

FIG. 9 is a flow chart of an example process 900 through which a technician may install combined gateway equipment 115 and/or outdoor broadband unit 200.

Process 900 may include installing combined gateway 115 and/or outdoor broadband unit (block 910). The installation may be performed by a technician at a customer location. The technician may, for example, install combined gateway 115 on the roof of a customer premise. In some implementations, the installation may be an upgrade of a previously installed satellite antenna by attaching extension arm 350 and radome 340 to support arm 410 of the satellite antenna. The installation may include connecting combined gateway 115 to coaxial cable 204, which may lead into the customer premise and from which power may be received. Once installed and connected to power, outdoor broadband unit 200 may begin operating. As discussed previously, the operation may include measuring signals relating to the received power from base station 120 and controlling visual indicator 520 based on these signals.

Process 900 may further include observing, by the technician, the visual indicators (i.e., visual indicator 520) to gauge the signal strength (block 920). Because the color of visual indicator 520 conveys the quality of the RF link, the installing technician can easily determine, without using any additional equipment, the quality of the RF link. As previously mentioned, visual indicator 520 may be installed on radome 340 in a location that makes the visual indicators particularly convenient for the technician to see. For example, visual indicator 520 may installed on the bottom of radome 340 so that the installer, when standing on a ladder and looking up at outdoor broadband unit 200, can see visual indicator 520.

The installer may adjust the position/orientation of outdoor broadband unit 200 (block 930). For example, the installer may loosen collar 420 and then rotate extension arm 350 to a position in which, based on visual indicator 520, outdoor broadband unit 200 gets the best signal reception. Based on visual indicator 520, the installer may finalize the final position/orientation of outdoor broadband unit 200 (block 940).

Systems and/or methods described herein may provide a CPE wireless architecture with a simplified initial installation. A technician installing the equipment may be able to visually verify, without using specialty equipment, a quality of the RF link to the customer premise. A multi-color LED may be used as a simple and relatively inexpensive way to convey a category of the RF link quality. Threshold values used to control the category thresholds may be dynamically changed in the equipment, allowing for categories that are easily customizable for the particular customer premise and/or equipment.

The foregoing description of implementations provides illustration and description, but is not intended to be exhaustive or to limit the invention to the precise form disclosed.

Modifications and variations are possible in light of the above teachings or may be acquired from practice of the invention.

For example, while series of blocks have been described with regard to FIGS. 8 and 9, the order of the blocks may be modified in other implementations. Further, non-dependent blocks may be performed in parallel.

It will be apparent that example aspects, as described above, may be implemented in many different forms of software, firmware, and hardware in the implementations illustrated in the figures. The actual software code or specialized control hardware used to implement these aspects should not be construed as limiting. Thus, the operation and behavior of the aspects were described without reference to the specific software code—it being understood that software and control hardware could be designed to implement the aspects based on the description herein.

Further, certain portions of the invention may be implemented as "logic" that performs one or more functions. This logic may include hardware, such as an application specific integrated circuit or a field programmable gate array, or a combination of hardware and software.

Even though particular combinations of features are recited in the claims and/or disclosed in the specification, these combinations are not intended to limit the invention. In fact, many of these features may be combined in ways not specifically recited in the claims and/or disclosed in the specification.

No element, act, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A device, comprising:

a radio frequency (RF) antenna;

a control module to connect to a Long-Term Evolution (LTE) network through the RF antenna; and a first light emitting diode (LED), disposed on an outer surface of the device, to emit light of a plurality of different colors, where the color to emit, of the plurality of different colors, is selected based on a quality of the connection to the LTE network, where the device includes an outdoor broadband unit connected to an external portion of a customer premise.

2. The device of claim 1, further comprising:

a second LED, disposed on the outer surface of the device, to emit a visual indication of whether the device is receiving power from a power supply.

3. The device of claim 2, where the first and second LEDs are disposed on a bottom surface of the device.

4. The device of claim 1, where the device further includes:

a radome to house the RF antenna, the control module, and a broadband home router (BHR).

5. The device of claim 1, where the device further includes:

a radome to house the RF antenna, the control module, and a bridge, the bridge to forward signals received over the RF antenna to a router located inside the customer premise.

6. The device of claim 1, where the control module is further to:

determine a first signal, relating to the quality of the connection to the LTE network, that represents an average received power, at the RF antenna; and determine a second signal, relating to the quality of the connection to the LTE network, that represents a signal to interference and noise ratio.

7. The device of claim 6, further comprising:

a first register to store one or more threshold values corresponding to the first signal; and a second register to store one or more threshold values corresponding to the second signal.

8. The device of claim 6, where the control module is further to:

categorize the first signal as corresponding to one of a plurality of signal quality categories based on the one or more threshold values stored in the first register;

categorize the second signal as corresponding to one of the plurality of signal quality categories based on the one or more threshold values stored in the second register; and control the LED to emit a color associated with a lowest one of the signal quality categories of the first signal and the second signal.

9. The device of claim 1, where the device further includes:

a broadband home router (BHR) connected to receive data from the control module.

10. The device of claim 1, further comprising:

a rotatable extension arm to mount the device.

11. The device of claim 1, where the control module is additionally to:

store one or more threshold values used to categorize the quality of the connection to the LTE network.

12. The device of claim 11, where the one or more threshold values are received over the LTE network.

13. The device of claim 11, where the one or more threshold values are stored during manufacture of the device or set by a technician during installation of the device.

14. A system comprising:

an outdoor broadband unit connected to an external portion of a customer premise, the outdoor broadband unit including:

a radio frequency (RF) antenna to receive communications from a Long-Term Evolution (LTE) network, a radome to house the RF antenna, a first light emitting diode (LED), disposed on an outer surface of the radome, to:

emit a first color of light when a quality of the communications with the LTE network are above a first threshold, emit a second color of light when the quality of the communications with the LTE network are below the first threshold and above a second threshold, and emit a third color of light when the quality of the communications with the LTE network are below the second threshold;

a satellite antenna to receive communications from a satellite network; and a support arm to hold the outdoor broadband unit and the satellite antenna.

15. The system of claim 14, further comprising:

a second LED, disposed on the outer surface of the radome, to emit a visual indication of whether the outdoor broadband unit is receiving power.

16. The system of claim 15, where the first and second LEDs are disposed on a bottom surface of the radome.

17. The system of claim 14, where the first LED is controlled to blink when a connection to the LTE network is active.

18. The system of claim 14, further including:

an extension arm mounted to the support arm and the outdoor broadband unit, the extension arm being rotatable around the support arm.

19. The system of claim 14, where the outdoor broadband unit further includes:

a control module to:

determine a first signal, relating to a quality of the connection to the LTE network, that represents an average received power, at the RF antenna; and determine a second signal, relating to the quality of the connection to the LTE network, that represents a signal to interference and noise ratio.

20. The system of claim 19, where the outdoor broadband unit further includes:

a broadband home router (BHR) connected to receive data, from the LTE network, via the control module.

21. The system of claim 14, where the outdoor broadband unit further includes:

a control module to:

store one or more threshold values used to categorize the quality of the connection to the LTE network.

22. The system of claim 21, where the one or more threshold values are received over the LTE network.

23. The system of claim 21, where the one or more threshold values are stored during manufacture of the device.

24. The system of claim 21, where the one or more threshold values are set, by a technician, during installation of the device.

25. A device implemented method comprising:

determining, by the device, a value representing a quality of a wireless connection of the device to a Long-Term Evolution (LTE) network;

receiving, by the device and over the connection to the LTE network, one or more threshold values that define a plurality of connection quality categories for the wireless connection to the LTE network;

determining, by the device, and based on comparison of the value representing the quality of the wireless connection with the one or more threshold values, a connection quality category, of the plurality of connection quality categories, corresponding to the quality of the wireless connection;

selecting, by the device and based on the determined category, one of a plurality of colors; and controlling, by the device, a light emitting diode (LED), disposed on an outer surface of the device, to emit the selected color.

26. The method of claim 25, where the received one or more threshold values are values that are customized for the location of the device in the LTE network.

27. The method of claim 25, where the value representing the quality of the wireless connection includes a first value representing an average received power at an antenna of the device or a second value representing a signal to interference and noise ratio.

28. A device, comprising:

a radio frequency (RF) antenna;

a control module to connect to a Long-Term Evolution (LTE) network through the RF antenna; and an indicator to generate an audio or visual signal, in a local vicinity of the device, based on a quality of the connection to the LTE network, where the device includes an outdoor broadband unit connected to an external portion of a customer premise.

29. The device of claim 28, where the indicator includes:

a light emitting diode (LED), disposed on an outer surface of the device, to blink in a predetermined sequence based on the quality of the connection to the LTE network.

30. The device of claim 28, where the indicator includes:

a liquid crystal display (LCD), disposed on an outer surface of the device, to generate a visual indication of the quality of the connection to the LTE network.

31. The device of claim 28, where the indicator includes:

a speaker to emit audible tones that convey the quality of the connection to the LTE network.

* * * * *